US010816286B2

(12) United States Patent
Fennelly

(10) Patent No.: US 10,816,286 B2
(45) Date of Patent: Oct. 27, 2020

(54) CONDENSER COIL CLEANING INDICATOR

(71) Applicant: Richard P. Fennelly, Cortlandt Manor, NY (US)

(72) Inventor: Richard P. Fennelly, Cortlandt Manor, NY (US)

(73) Assignee: Coil Pod LLC, Yorktown Heights, NY (US)

( * ) Notice: Subject to any disclaimer, the term of this patent is extended or adjusted under 35 U.S.C. 154(b) by 346 days.

(21) Appl. No.: 14/544,293

(22) Filed: Dec. 20, 2014

(65) Prior Publication Data

US 2015/0176932 A1 Jun. 25, 2015

Related U.S. Application Data

(60) Provisional application No. 61/964,032, filed on Dec. 23, 2013.

(51) Int. Cl.
*F28G 15/00* (2006.01)
*F28F 27/00* (2006.01)

(52) U.S. Cl.
CPC ..... *F28G 15/003* (2013.01); *F28F 27/00* (2013.01)

(58) Field of Classification Search
CPC ..... B60H 1/00; F28G 15/00; F28G 15/003; G01K 17/12; F28F 27/00
USPC ..... 165/11.1, 95, 287; 134/14
See application file for complete search history.

(56) References Cited

U.S. PATENT DOCUMENTS 3,312,274 A 4/1967 Sebald
4,390,058 A * 6/1983 Otake ..... F28G 1/12 165/11.1
4,702,620 A * 10/1987 Ford ..... G01M 15/048 374/102
4,766,553 A 8/1988 Kaya et al.
4,798,055 A 1/1989 Murray et al.
5,333,674 A 8/1994 Czolkoss et al.
5,385,202 A 1/1995 Drosdziok et al.
6,272,868 B1 * 8/2001 Grabon ..... F28B 11/00 165/11.1
6,295,696 B1 10/2001 Harmon
6,386,272 B1 * 5/2002 Starner ..... G01B 7/06 165/11.1
6,427,772 B1 8/2002 Oden et al.
6,467,282 B1 * 10/2002 French ..... F25D 21/006 62/140
6,708,507 B1 3/2004 Sem et al.
7,079,967 B2 * 7/2006 Rossi ..... F24F 11/0086 62/127
7,178,410 B2 2/2007 Fraden et al.
7,652,586 B2 1/2010 Baller et al.
7,908,875 B2 3/2011 Smith
8,100,167 B2 * 1/2012 Thybo ..... B60H 1/00978 165/11.1
8,182,611 B2 5/2012 Yoo
8,590,100 B2 11/2013 Agorichas
2007/0158058 A1 * 7/2007 Arshad ..... B60H 1/00735 165/202
2009/0151656 A1 * 6/2009 Jones ..... F22B 37/486 122/390
2009/0250085 A1 * 10/2009 Gaus ..... F28G 15/003 134/56 D
2012/0008035 A1 * 1/2012 Ichii ..... H04N 5/23245 348/333.01
2012/0143528 A1 * 6/2012 Kates ..... F24F 11/0086 702/45
2012/0198863 A1 * 8/2012 Hall ..... F25D 21/006 62/80
2012/0247709 A1 * 10/2012 Soldan ..... F28F 27/00 165/11.1
2014/0008035 A1 * 1/2014 Patankar ..... F28F 27/00 165/11.1
2015/0285539 A1 * 10/2015 Kopko ..... F25B 5/02 62/115
2016/0160800 A1 6/2016 Knowles et al.

FOREIGN PATENT DOCUMENTS

CN 103245252 A * 8/2013
JP 62162852 A * 7/1987
JP H0678814 B2 * 10/1994 ..... F23N 5/242
JP 08029045 A * 2/1996
JP 10111979 A * 4/1998
JP 2002150417 A * 5/2002 ..... F25B 49/02

OTHER PUBLICATIONS

JP2002150417A Machine Translation.*
Machine Translation JP2002150417A.*
Traulsen : INTELLA-TRAUL Master Service Manual, pp. 10 and 30.

* cited by examiner

*Primary Examiner* — Len Tran
*Assistant Examiner* — Gustavo A Hincapie Serna
(74) *Attorney, Agent, or Firm* — Richard P. Fennelly

(57) ABSTRACT

The need to clean dirty condenser coils in an operating refrigeration appliance is performed by connecting a temperature monitor to the coil to signal when a predetermined rise in temperature has occurred from a baseline temperature that exists when the coil structure is clean. The temperature monitor can merely provide the actual temperature reading or it can be programmed for the selected temperature rise to light up or display an appropriate message that coil cleaning needs to be done.

4 Claims, No Drawings

CONDENSER COIL CLEANING INDICATOR

This application claims the benefit of U.S. Provisional Patent Application Ser. No. 61/964,032, filed Dec. 23, 2013.

The present invention relates to a system for signaling the need to clean the condenser coils in an operating refrigerator or freezer appliance.

As is well known in the art, the condenser coils of refrigeration and freezer appliances become dirty over time, harming the efficiency of such coils to reject heart drawn from the cooled compartment(s) in those appliances into the outside atmosphere. The term "refrigeration" as used herein is used in the generic sense to cover any cooling appliance using the refrigeration cycle. As a result, the appliances run less efficiently, consuming more electricity than they would if they were clean. Additionally, the retained heat causes the units to run hotter and at higher temperatures often causing premature service calls and, possibly, compressor failure. The textbook "Refrigeration and Air Conditioning Technology by Bill Whitman et al., for example, states (on p. 766) that "[d]irty condenser coils often result in inefficiency. Once the coil gets dirty, the condenser has a hard time rejecting heat". It further states "[i]f the condenser cannot reject heat fast enough, it will accumulate heat . . . ." This publication does not address how to remotely indicate that the coils are becoming dirty over time as the appliance is being operated.

The manufacturers of these appliances hide the condenser coils, which are far from appealing to the eye, usually behind a louvered grille or panel. Placing the coils out of sight also hides them from the view of the appliance's owner who has a clear pecuniary interest in knowing whether or not they are in need of cleaning. The only way it can be determined if cleaning is really needed (or desired) requires the step of removal of the grille (or other panel structure) hiding the coils from view. It would be desirable to have an indicator system for the appliance that signals the owner when the coils have become dirty without the need for the owner to remove the grille or panel hiding them from view.

There have been certain disclosures in the prior art that mention both such dirty coils and detection means for such a condition. U.S. Pat. No. 7,079,967 utilizes at least five sensors in its apparatus and method and in FIG. 1 illustrates apparent measurement of outdoor atmospheric temperature (AMB) and, optionally, the air off condenser temperature (AOC). See as well Col. 6, lines 9-27 and lines 51-59. The link of these reading to a dirty condenser coil condition is further described at Col. 11, line 44 to Col. 12, line 3 of this patent.

A commercially available example of a device directed to signaling a dirty condenser coil condition is given in Trauslen's "Intela-Traul Master Service Manual. Relevant disclosures in that manual include pages 10 (note the sensor is in the return air side of the evaporator coil), 12-16, and 30 (describing the condenser clean alarm).

The present invention is directed to a differing and more Simple means to indicate a dirty condenser coil condition. It relies upon the attachment (or direct connection) of a suitable temperature monitoring device to the condenser coil itself to signal that it is running at a selected temperature above the temperature than the lower baseline temperature that would be registered when it is in a cleaner condition. The invention takes advantage of the known fact that dirty coils run at a somewhat elevated temperature as compared to clean coils. The temperature monitor can merely give a readout of the actual temperature which will inform the owner that an undesired upward departure from the baseline temperature for a clean coil has occurred. Alternatively, a suitably programmed temperature monitor can be used which would light up to indicate a previously selected undesired temperature rise or which would display a message, such as "Clean Me", at the point of a selected and undesired temperature rise. For example, if clean coils run at temperatures of say 95 degrees F. and completely dirty coils run at 115 degrees F., the temperature monitor can be set at some intermediate temperature (e.g., 105 degrees F.) so that a cleaning can be performed at a point where there is sufficient dirt and debris on the coils to justify cleaning but before the coils become too dirty. In setting any temperature for triggering of the monitor's action, the ambient temperature of the appliance's location should also be considered. Normally, most stores are cooled in hotter weather and heated in cooler weather so that customers are comfortable (e.g., 68-72 degrees F. would be ambient). Clean condenser coils, which are responsible for heat rejection during the refrigeration cycle, will normally run at higher temperatures than such comfortable temperatures for humans, e.g., probably from the low 90s F to perhaps 100 F or so. Therefore, a trigger point somewhat above this range should be acceptable in most cases.

I claim:

1. A method for signaling the need to clean condenser coils having dirt and debris on the outside of the coils in an operating refrigeration appliance which comprises directly connecting a temperature monitor to the coils as the only means to signal a need for coil cleaning when a predetermined rise in temperature has occurred from a baseline temperature that exists when the coils are clean.

2. The method as claimed in claim 1 wherein the temperature monitor indicates an actual risen, predetermined temperature.

3. The method as claimed in claim 1 wherein the temperature monitor is predetermined to light up at an actual risen, predetermined temperature.

4. The method as claimed in claim 1 wherein the temperature monitor is predetermined to display a message at an actual risen, predetermined temperature.

* * * * *